US006817147B1

(12) United States Patent
MacDonald

(10) Patent No.: US 6,817,147 B1
(45) Date of Patent: Nov. 16, 2004

(54) CLIP FOR PANEL TRIM

(75) Inventor: Douglas B. MacDonald, Caledonia, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/475,532

(22) Filed: Dec. 30, 1999

(51) Int. Cl.[7] ..... E04C 2/52

(52) U.S. Cl. ..... 52/220.7; 52/36.1; 52/36.6; 52/239; 52/242; 52/712

(58) Field of Search ..... 52/36.4, 36.5, 52/36.6, 238.1, 239, 240, 241, 712, 714, 715, 36.1, 242, 220.1, 26.7, 220.8; 403/83 B, 110; 248/65.1 B, 226.11, 231.71, 231.01, 231.9

(56) References Cited

U.S. PATENT DOCUMENTS

| | | | | | |
|---|---|---|---|---|---|
| 1,856,150 | A | | 5/1932 | Baum | |
| 1,929,302 | A | | 10/1933 | Boyle | |
| 2,705,887 | A | | 4/1955 | Xanten | |
| 2,959,896 | A | * | 11/1960 | Schneller | |
| 3,279,795 | A | * | 10/1966 | Larson | |
| 4,434,596 | A | * | 3/1984 | McAteer | 52/238 |
| 4,559,751 | A | | 12/1985 | Rogers | |
| 4,569,172 | A | * | 2/1986 | Weinar | 52/281 |
| 4,598,518 | A | * | 7/1986 | Hohmann | 52/410 |
| 4,640,063 | A | | 2/1987 | Ayala | |
| 4,735,030 | A | * | 4/1988 | Judkins | 52/762 |
| 4,819,401 | A | | 4/1989 | Whitney, Jr. | |
| 4,949,519 | A | | 8/1990 | Jeffers | |
| 5,029,788 | A | * | 7/1991 | Hoskinson et al. | 248/218.1 |
| 5,881,518 | A | | 3/1999 | Edwards et al. | |
| 5,896,722 | A | * | 4/1999 | Swenson | 52/712 |
| 5,899,035 | A | | 4/1999 | Waalkes et al. | |
| 6,009,675 | A | | 1/2000 | Waalkes et al. | |
| 6,098,358 | A | | 8/2000 | Waalkes et al. | |

* cited by examiner

*Primary Examiner*—Carl D. Friedman
*Assistant Examiner*—Yvonne M. Horton
(74) *Attorney, Agent, or Firm*—Price, Heneveld, Cooper, DeWitt & Litton

(57) ABSTRACT

A clip for retaining a cover to a partition frame member of the type having openings on opposite side faces. The clip includes an elongated flexible member having a U-shape defining a base portion and a pair of arms extending therefrom. Each arm includes an end portion extending inwardly, and having a shape that permits reception of the end portions in openings of a partition frame member to thereby retain the clip on the partition frame in an orientation wherein the base portion is spaced-apart from the partition frame member to permit vertical routing of utility lines along the partition frame member and through the clip.

17 Claims, 6 Drawing Sheets

CLIP FOR PANEL TRIM

BACKGROUND OF THE INVENTION

The present invention relates to a clip that retains a cover panel to a partition frame member, and in particular to a U-shaped clip that permits vertical routing of utility lines within the cover.

The efficient use of building floor space is an ever-growing concern, in particular as building costs continue to escalate. Open office plans have been developed to reduce overall officing costs, and generally incorporate large, open floor spaces in buildings that are equipped with module furniture systems which are readily reconfigurable to accommodate the ever changing needs of a specific user, as well as the divergent requirements of different tenants. One arrangement panel used for furnishing open plans includes movable or portable partition panels that are detachably interconnected to partition off the open spaces into individual workstations and/or offices. Such partition panels have sufficient strength to receive hang-on furniture units, such as work surfaces, overhead cabinets, shelves, etc., and are generally known in the office furniture industry as "systems furniture." In addition, such partition panels have an acoustical, sound-absorbing configuration to promote a quiet, pleasant work environment.

Such partition systems commonly include a variety of cover panels, such as large, flat cover panels that extend across the sides of the partitions, providing a decorative appearance, as well as contributing to the acoustical properties of the partition system. Partition systems may also include a plurality of elongated, narrow covers or trim pieces that extend horizontally along the top edge of the partition panels to provide a decorative appearance and close off the top edge of the partition. Also, partitions may include one or more elongated, vertically extending covers that close off the partition frame at end-of-run locations. Various mounting arrangements have been developed to secure such cover panels to the partition frame. However, existing mounting arrangements may not provide a secure attachment of the cover, and furthermore, may interfere or prevent vertical wiring within the partition panel.

Accordingly, it would be desirable to have a cover panel and mounting arrangement alleviating the above-identified drawbacks of prior arrangements.

SUMMARY OF THE INVENTION

One aspect of the present invention is to provide a clip for retaining a cover to a partition frame member of the type having openings on opposite side faces. The clip includes an elongated flexible member having a U-shape defining a base portion and a pair of arms extending therefrom. Each arm includes an end portion extending inwardly, and having a shape that permits reception of the end portions in openings of a partition frame member to thereby retain the clip on the partition frame in an orientation wherein the base portion is spaced-apart from the partition frame member to permit vertical routing of utility lines along the partition frame member and through the clip.

Another aspect of the present invention is a partition panel including a partition frame having at least one vertical frame member at a side edge of the partition frame. An end cover forms a vertically-extending passageway for routing of utility lines. A clip supports the end cover on the vertical frame member, and the clip has a base portion with a pair of arms extending from the base portion to form a U-shape. The arms engage the vertical frame member and position the base away from the vertical frame member to permit vertical routing of utility lines within the vertically-extending passageway along the vertical frame member and through the clip.

Yet another aspect of the present invention is a clip for retaining an elongated end cover on a vertical frame member of a partition frame. The clip is formed from a flexible wire, and has a base portion and flexible arms extending therefrom. Each arm has an end portion configured to engage a vertical frame member to support an end cover and also permit vertical routing of utility lines between the cover and vertical frame member.

These and other advantages of the present invention will be further understood and appreciated by those skilled in the art by reference to the following written specification, claims, and appended drawings.

DETAILED DESCRIPTION OF PREFERRED EMBODIMENT

Figure 1:
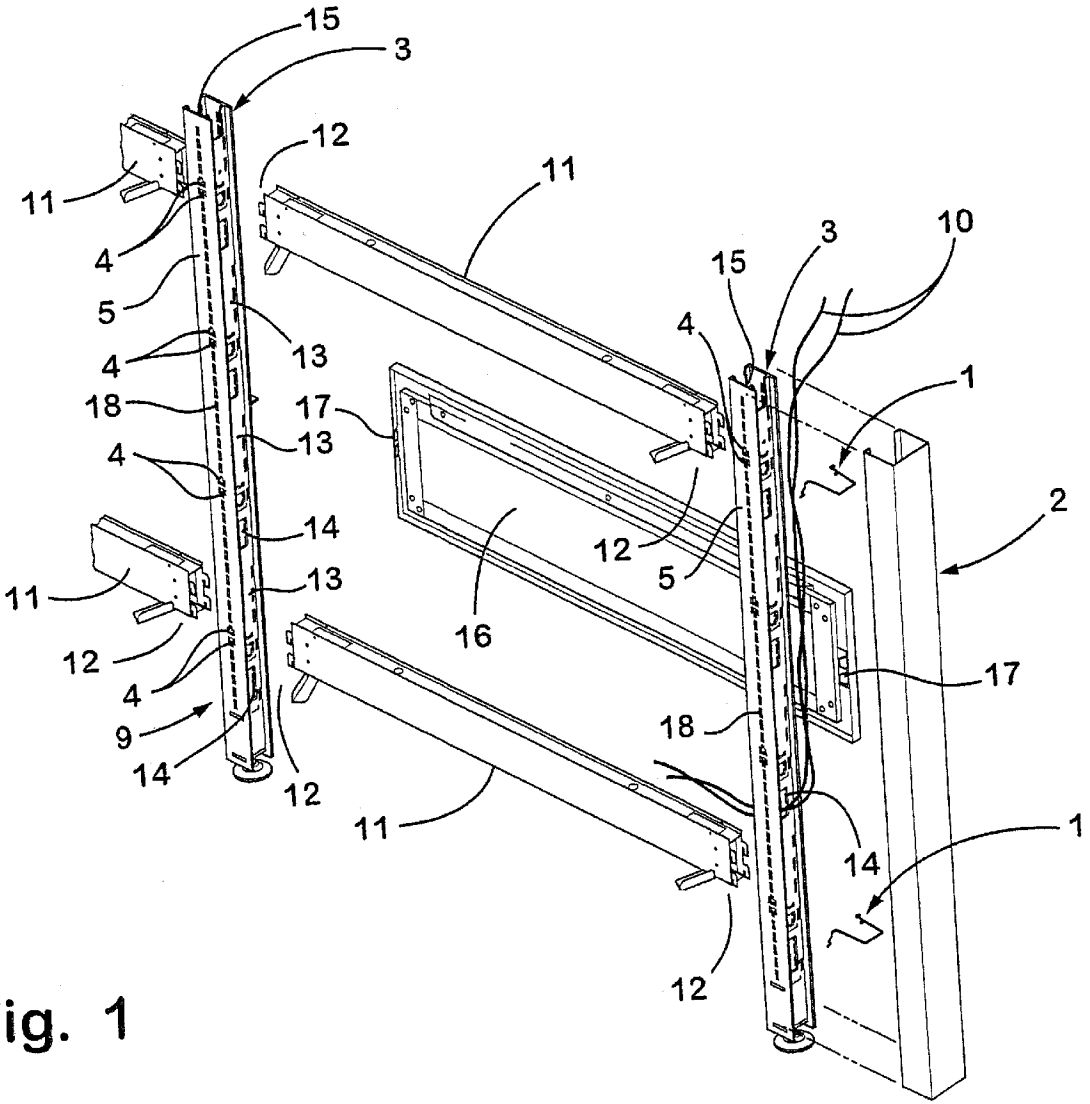
FIG. 1 is a fragmentary, partially exploded perspective view of a partition frame, cover, and retainer clip embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. As used herein and unless stated otherwise, a U-shaped clip or other object is a clip or object which has a configuration which includes a substantially U-shaped portion.

Figure 2:
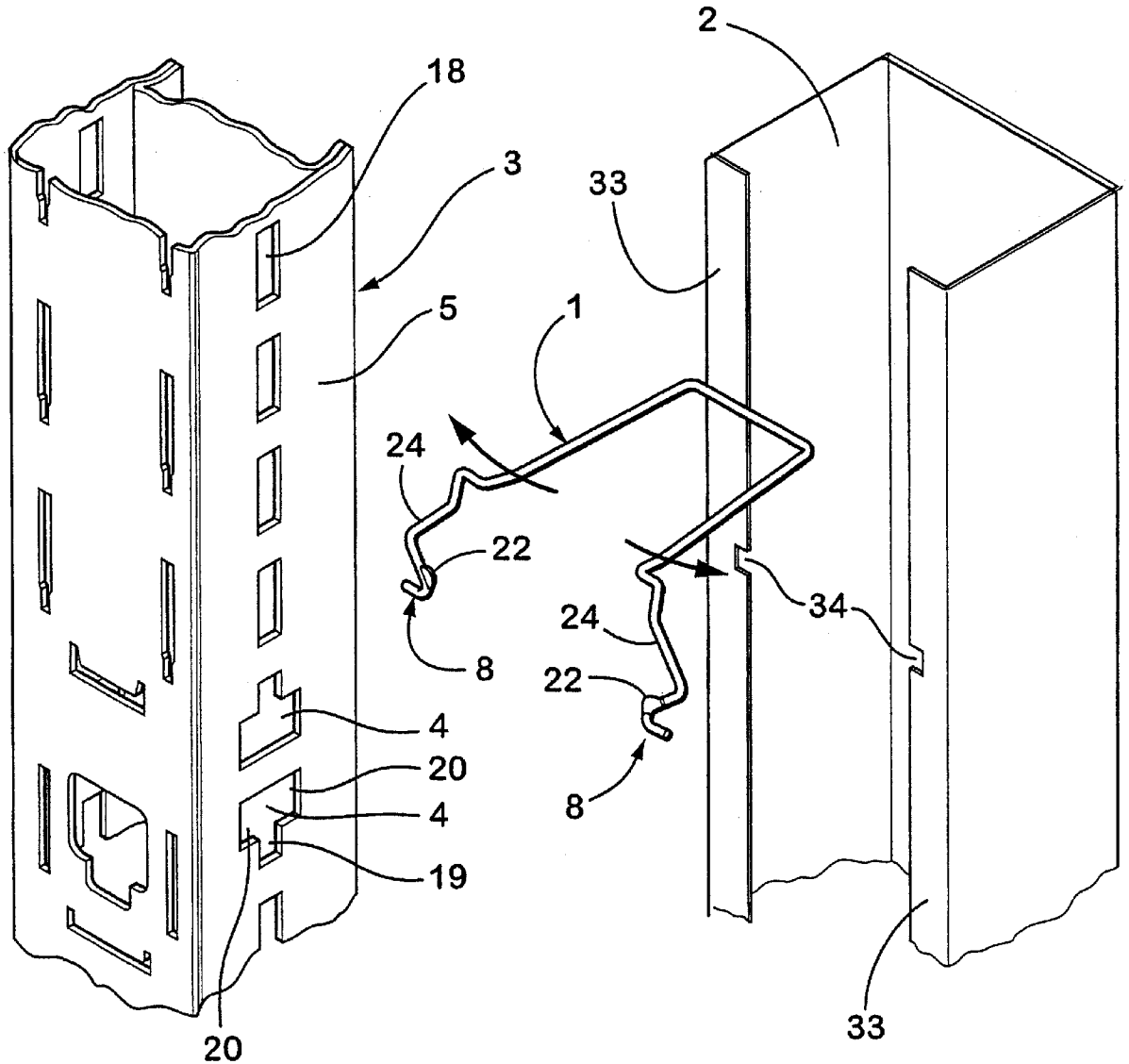
FIG. 2 is a fragmentary, exploded perspective view of a portion of the partition frame of FIG. 1.
Figure 4:
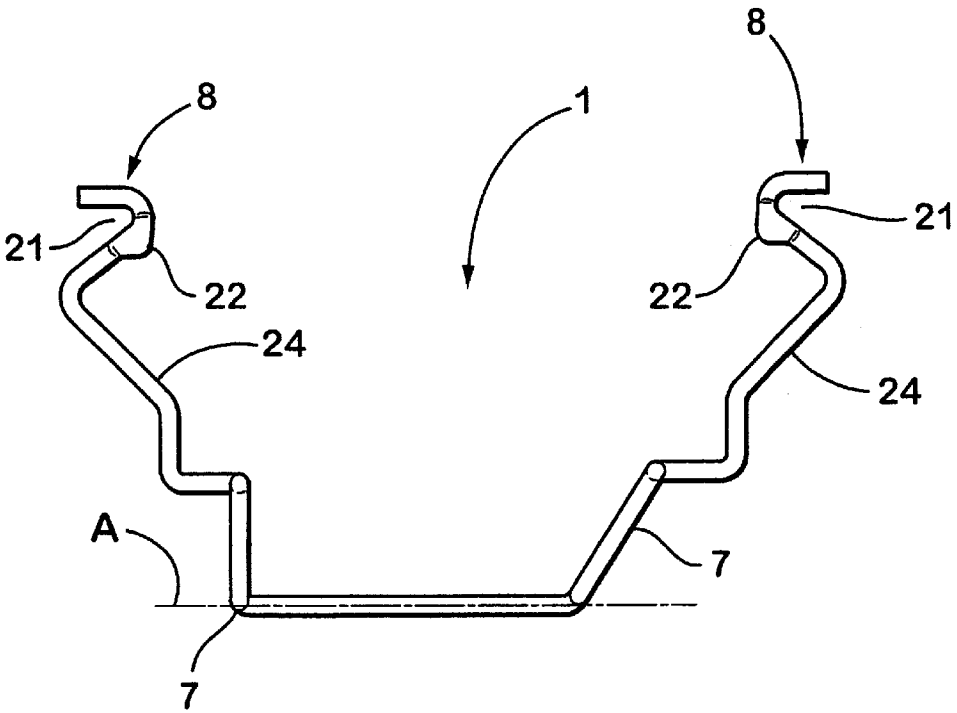
FIG. 4 is a view of the clip of FIG. 3 taken along the center line of one of the arms of the clip.
Figure 3:
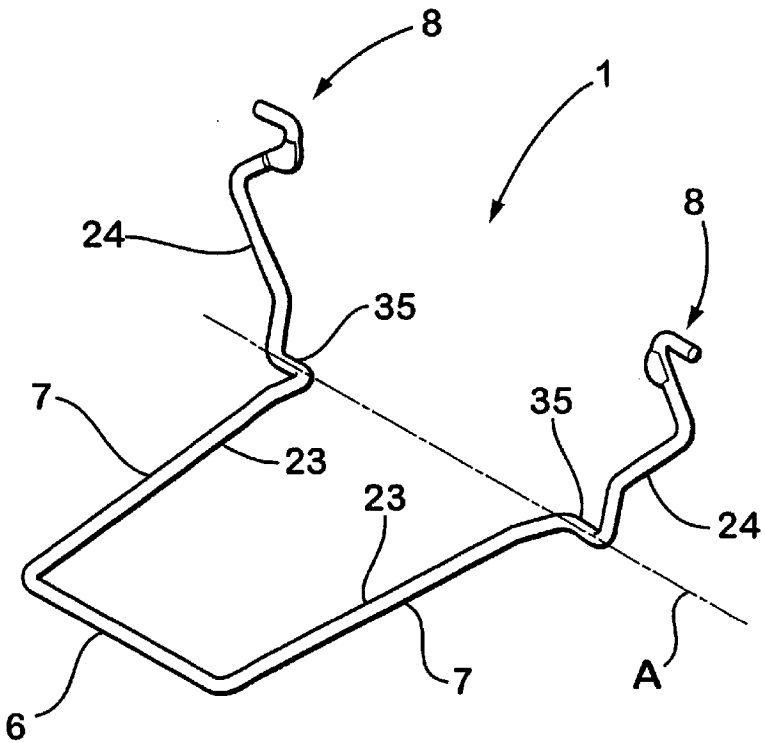
FIG. 3 is a perspective view of the clip.

The reference numeral 1 (FIG. 1) generally designates a clip embodying the present invention, which is particularly designed to retain a cover 2 to a partition frame member, such as a post 3 of the type having openings 4 on opposite side faces 5 of the post 3. With further reference to FIGS. 2–4, clip 1 is an elongated flexible member having a U-shape defining a base portion 6, and a pair of arms 7 extending from the base 6. Each arm 7 includes an end portion 8 that extends inwardly. End portions 8 have a shape that permits reception of the end portions in the openings 4 of the post 3 to retain the clip 1 on a partition frame 9 in an orientation wherein the base portion 6 is spaced-apart from the post 3 to permit vertical routing of utility lines 10 along the post 3 and through the clip 1. The U-shaped configuration of the clip allows the clip to be positioned in the cover whereby the open end of the cover remains accessible for the laying in of wiring and a substantial cross sectional area of the cover remains open for the routing of such wiring.

Partition frame 9 is described in detail in U.S. Pat. No. 6,098,358, entitled KNOCK-DOWN PORTABLE PARTITION SYSTEM, issued on Aug. 8, 2000, the entire contents of which are hereby incorporated herein by reference. Related partitions are also disclosed in U.S. Pat. No. 6,009,675, entitled KNOCK-DOWN PORTABLE PARTITION SYSTEM, issued on Jan. 4, 2000, and U.S. Pat. No. 5,899,035, entitled KNOCK-DOWN PORTABLE PARTITION SYSTEM, issued on May 4, 1999, the entire contents of each of which is hereby incorporated herein by reference. Accordingly, the partition frame 9 will not be described in detail. Partition frame 9 includes upright frame members such as posts 3 that are rigidly interconnected by beams 11. The opposite ends of each beam 11 include threadless quick-disconnect connectors 12 that rigidly interconnect the beams 11 with the posts 3 to permit assembly of the partition frame 9 during installation. The quick-disconnect connectors 12 connect to the beam connection ports 13 of posts 3. Posts 3 have a plurality of relatively large openings 14 that permit pass-through of utility lines 10. Utility lines 10 may be power lines, communication lines, or other utility lines as required for a particular application. A cover panel 16 includes panel clips 17 that are received within openings 4 (FIG. 2) to retain cover panel 16 on the frame 9. Posts 3 include a vertical row of openings 18 that receive hooks of hang-on accessory units (not shown), such as storage bins, worksurfaces, and the like. Openings 4 include a center portion 19 having substantially the same shape as openings 18 for receiving hooks of hang-on accessory units. Openings 4 also include cut-out side portions 20 that receive clips 17. This arrangement permits clips 17 to engage openings 4 without interfering with the hooks of the hang-on accessory units.

When the clip 1 is installed to the post 3, the end portions 8 are received within the side portions 20 of openings 4 to retain the clip 1 on the post 3. The end portions 8 have a small U-shaped portion 21 that extends inwardly, and a flattened section 22 engages the opening 4. The proximal portions 23 of arms 7 and base 6 lie in a first common plane. Distal portions 24 of arms 7 lie in a second plane that intersects the first common plane to define a bend axis "A". Arms 7 include an intermediate portion 35 adjacent the end portions 8 that extend outwardly and generally parallel to the base portion 6.

Figure 5:
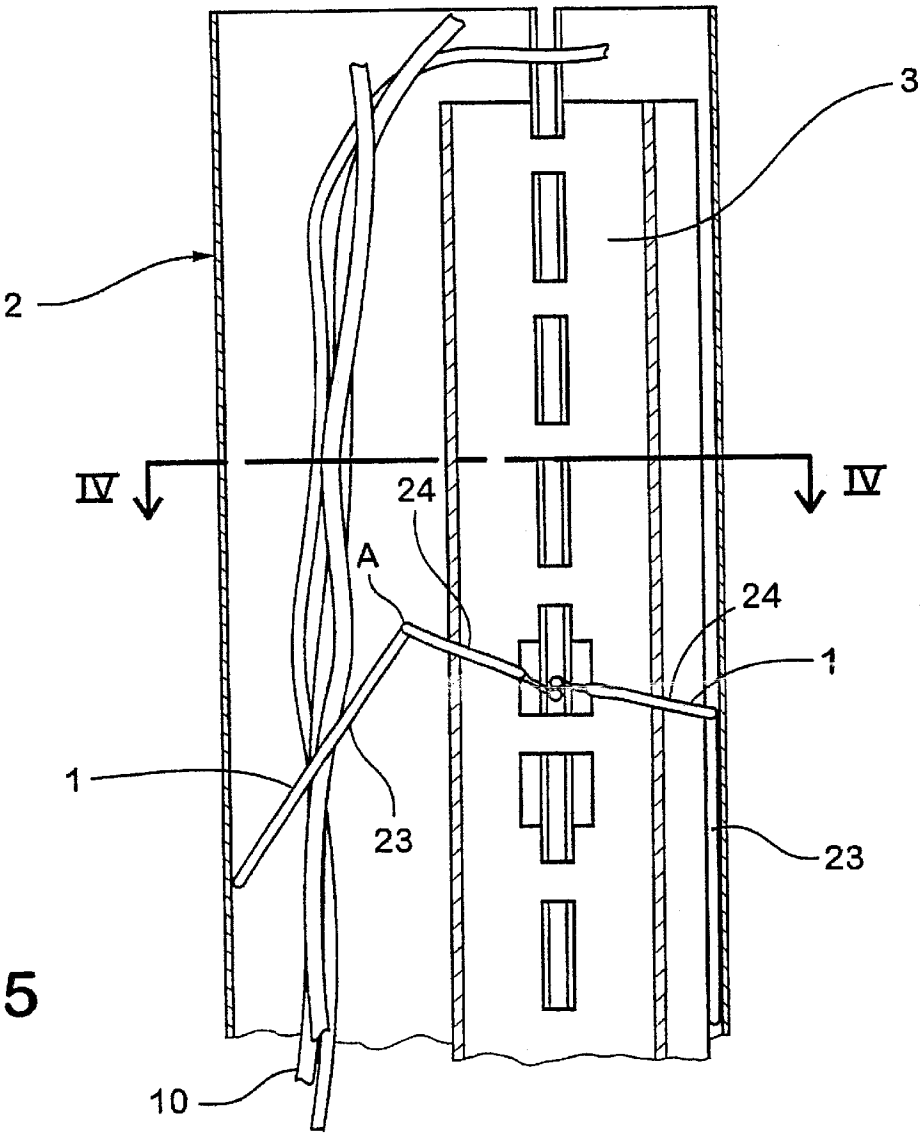
FIG. 5 is a fragmentary, side elevational view of a post having first and second covers mounted on sides of the post.
Figure 6:
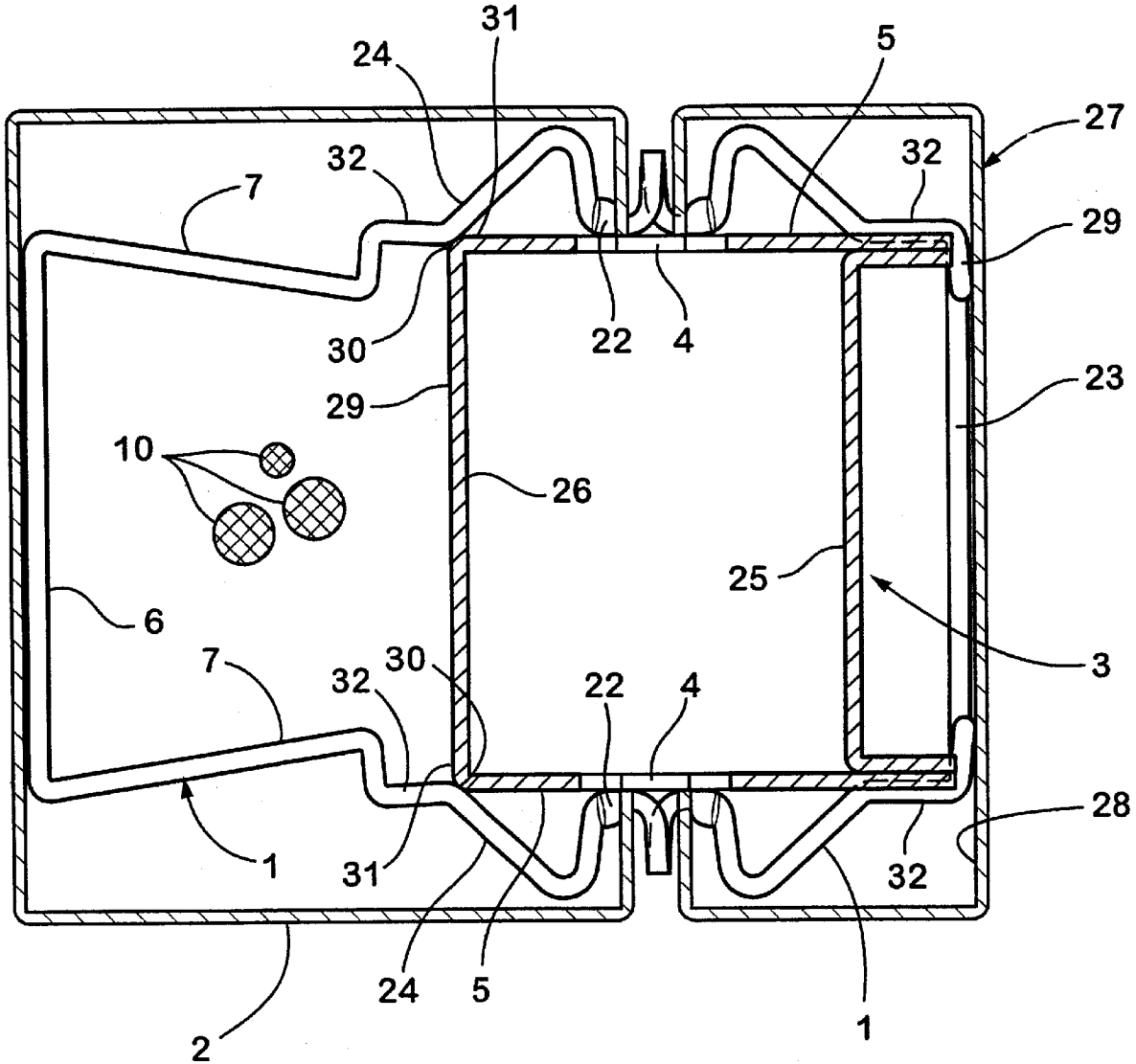
FIG. 6 is a cross-sectional view of the frame member and post of FIG. 5 taken along the line IV—IV.
Figure 7:
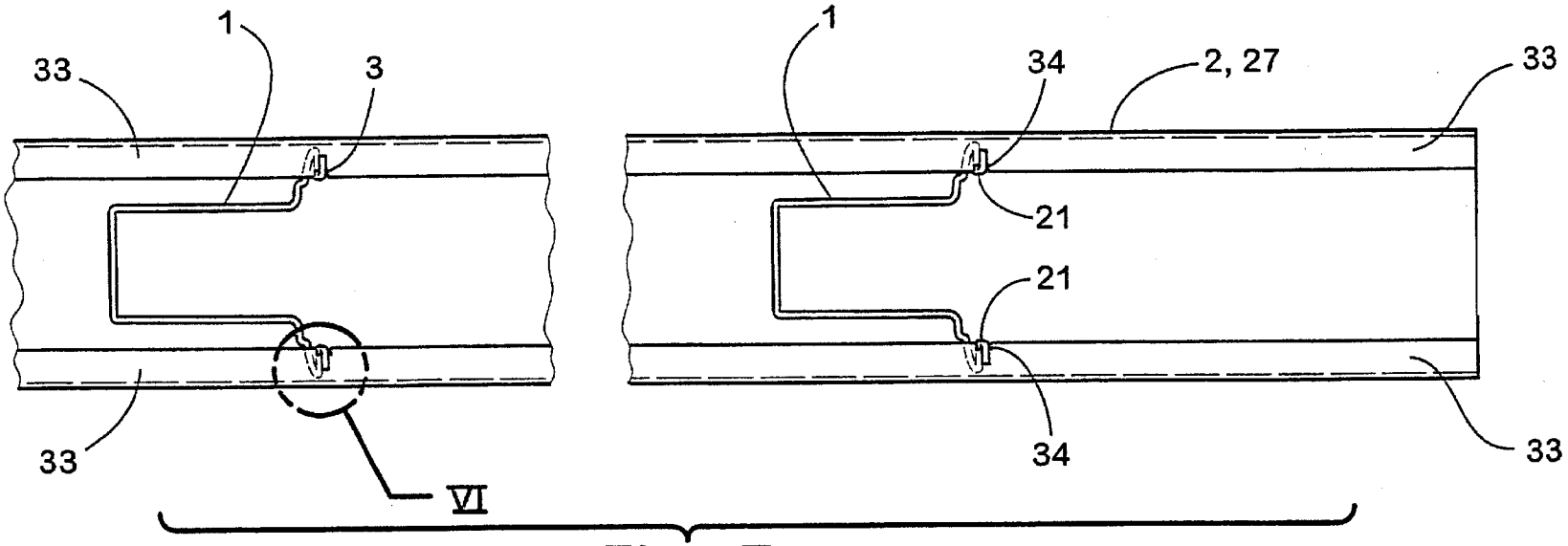
FIG. 7 is a fragmentary view of a cover having a pair of retainer clips attached thereto.

With reference to FIGS. 5 and 6, post 3 includes a small U-shaped channel 25 that nests within a larger U-shaped channel 26 to form the tubular post 3. For purposes of illustration, the post 3 of FIGS. 5 and 6 has a larger cover 2 mounted along one face, and a smaller cover 27 mounted along the opposite face. Larger cover 2 forms a vertical passageway that permits vertical routing of utility lines 10 along post 3 within the cover 2 and through the clip 1. Smaller cover 27 may also be mounted to a post 3 utilizing the clip 1 of the present invention. The inner surface 28 of cover 27 is positioned directly adjacent the face 29 of post 3, such that there is substantially less space available for routing of utility lines 10 within cover 27. Significantly, clip 1 has a configuration that permits mounting either a larger cover 2, a smaller cover 27 or other covers (not shown) having alternative sizes. When installing a larger cover 2, the inner surface 30 (FIG. 6) of distal portion 24 of clip 1 contacts the corner 30 formed by the inner section of the face 29 with the side faces 5 of post 3. As discussed above, the flattened section 22 of end 8 of arms 7 is received within openings 4 of post 3. Due to the contact of the inner surface 30 with corner 31, the clip 1 is positioned at an angle (FIG. 5), with the base portion 6 spaced-apart from the post 3 to permit routing of utility lines 10 along the post 3.

Figure 8:
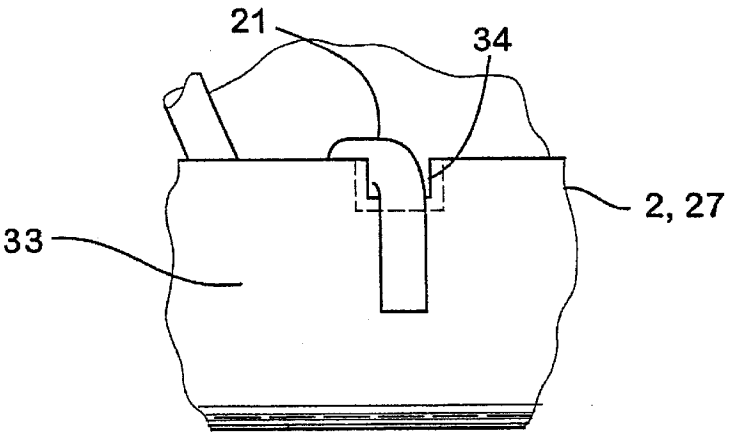
FIG. 8 is an enlarged view of the retainer clip of FIG. 7 illustrating the engagement of the end portion of the clip with the cover.

Alternately, when smaller cover 27 is mounted to the post 3, the arms 7 are flexed outward slightly, such that the straight portion 32 of the arms 7 contacts the opposite side faces 5 of post 3, thereby positioning the clip 1 with the proximal portion 23 of arms 7 in a substantially vertical position. Inner surface 28 of cover 27 is positioned closely against the face 29 of post 3. Covers 2 and 27 each have a generally U-shaped cross-section, with inwardly-extending flanges 33. Flanges 33 include a cut-out notch 34. When the clip 1 is installed to the cover 2 or 27, the U-shaped portion 21 of end 8 fits into notch 34 (FIG. 8), such that the cover 2 or 27 is supported on clip 1 when clip 1 is installed to the post 3. Depending upon the length of the cover 2 or 27, two or more clips 1 may be utilized for support of the cover.

During installation, the clip 1 is first connected to the cover 2 or 27 by engaging U-shaped portions 21 with notches 34. The clip 1 can be pivoted to the required position within the cover, depending upon whether a larger cover 2, or a smaller cover 27 is being used. The cover 2 or 27 is then slid over the post 3 until the flattened sections 22 engage the side portions 20 of openings 4.

The clip 1 of the present invention is very simple and cost-effective. Furthermore, clip 1 permits mounting of covers having different sizes, without requiring a different clip design for each cover. Finally, the clip 1 of the present invention permits vertical routing of utility lines within the cover if required.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A clip for retaining a cover to a partition frame member of the type having openings on opposite side faces, said clip comprising:

an elongated flexible member having a U-shape defining a base portion and a pair of arms extending therefrom, each arm including an end portion, said end portions extending inwardly and adapted to permit reception of said end portions in openings of a partition frame member to thereby retain said clip on the partition frame in an orientation wherein said base portion is adapted to be spaced-apart from the partition frame member to permit vertical routing of utility lines along the partition frame member and through said clip; and wherein:

said arms include an intermediate portion adjacent said end portions that extends outwardly and generally parallel to said base portion, said end portions extending transversely from said intermediate portions and including inwardly-extending U-shaped ends.

2. A clip for retaining a cover to a partition frame member of the type having openings on opposite side faces, said clip comprising:

an elongated flexible member having a U-shape defining a base portion and a pair of arms extending therefrom, each arm including an end portion, said end portions extending inwardly and adapted to permit reception of said end portions in openings of a partition frame member to thereby retain said clip on the partition frame in an orientation wherein said base portion is adapted to be spaced-apart from the partition frame member to permit vertical routing of utility lines along the partition frame member and through said clip; and wherein:

said arms include a proximal portion adjacent said base portion and lying in a common first plane therewith, each arm further including a distal portion, said distal portions lying in a common second plane, said first and second planes forming an angle relative to one another and intersecting to define a bend line.

3. The partition panel set forth in claim 2, wherein:

said arms are adapted to engage said vertical frame member to permit said clip to be secured to said vertical frame member in a selected one of a plurality of positions for use with end covers of various sizes.

4. The partition panel set forth in claim 3, wherein:

said arms are adapted to be flexed outwardly when said clip is installed to position said base portion of said clip against said vertical frame member for mounting of a low-profile end cover directly against said vertical frame member.

5. The partition panel set forth in claim 3, wherein:

said arms include a proximal portion adjacent said base portion and lying in a common first plane therewith, each arm further including a distal portion, said distal portions lying in a common second plane, said first and second planes forming an angle relative to one another and intersecting to define a bend line, said bend line disposed between said base portion and said engagement surfaces.

6. The partition panel set forth in claim 2, wherein:

said arms include a proximal portion adjacent said base portion and lying in a common first plane therewith, each arm further including a distal portion, said distal portions lying in a common second plane, said first and second planes forming an angle relative to one another and intersecting to define a bend line.

7. A partition panel, comprising:

a partition frame having at least one vertical frame member at a side edge of said partition frame;

an end cover forming a vertically-extending passageway for routing of utility lines; and a clip supporting said end cover on said vertical frame member, said clip having a base portion and a pair of arms extending from said base portion to form a U-shape, said arms engaging said vertical frame member and positioning said base away from said vertical frame member to permit vertical routing of utility lines within said vertically-extending passageway along said vertical frame member and through said clip.

8. The partition panel set forth in claim 7, wherein:

said end cover has a U-shaped cross section with a pair of flanges extending along said end cover to form free edges, said flanges including a notch; and said arms having ends positioned in said notches to support said end cover.

9. The partition panel set forth in claim 7, wherein:

said vertical frame member has openings in opposite side faces, an end portion of said arms partially extending into said openings to support said clip on said vertical frame member.

10. The partition panel set forth in claim 7, wherein:

said clip is formed from an elongated flexible metal wire.

11. The partition panel set forth in claim 10, wherein:

said vertical frame member has opposite side faces defining a post width, said arms of said clip having engagement surfaces spaced-apart a distance that is less than said post width.

12. A clip for retaining an elongated end cover on a vertical frame member of a partition frame, said clip formed from a flexible wire and having a base portion and flexible arms extending therefrom, each arm having an end portion configured to engage a vertical frame member to support an end cover and permit vertical routing of utility lines between the cover and the vertical frame member, said end portions of said arms having a U-shaped bend; and wherein:

said wire defines a diameter; and said end portions include a flattened section defining a thickness less than said diameter.

13. The clip set forth in claim 12, wherein:

said arms have intermediate portions adjacent said end portions and extending outwardly and parallel to said base portion.

14. The clip set forth in claim 13, wherein:

said end portions of said arms extend transversely relative to said base portion.

15. The clip set forth in claim 14, wherein:

said base portion and said arms define a U-shape.

16. The clip set forth in claim 15, wherein:

said base portion is straight.

17. The clip set forth in claim 16, wherein:

said wire is metal.

* * * * *